US011547226B2

(12) United States Patent
Garbutt et al.

(10) Patent No.: US 11,547,226 B2
(45) Date of Patent: Jan. 10, 2023

(54) FOOD PROTECTION APPARATUSES, ASSEMBLIES, AND METHODS OF USE

(71) Applicant: CLEAN LIDZ LLC, Newport Beach, CA (US)

(72) Inventors: Brian Garbutt, Newport Beach, CA (US); Cheree Garbutt, Newport Beach, CA (US); Luis E. Morales, Newport Beach, CA (US)

(73) Assignee: CLEAN LIDZ LLC, Newport Beach, CA (US)

( * ) Notice: Subject to any disclaimer, the term of this patent is extended or adjusted under 35 U.S.C. 154(b) by 0 days.

(21) Appl. No.: 17/357,740

(22) Filed: Jun. 24, 2021

(65) Prior Publication Data

US 2021/0401202 A1 Dec. 30, 2021

Related U.S. Application Data

(60) Provisional application No. 63/043,723, filed on Jun. 24, 2020.

(51) Int. Cl.

| | |
|---|---|
| ***A47G 19/26*** | (2006.01) |
| ***F21V 35/00*** | (2006.01) |
| ***F21W 121/00*** | (2006.01) |

(52) U.S. Cl.

CPC ..... *A47G 19/26* (2013.01); *F21V 35/006* (2013.01); *F21W 2121/002* (2013.01)

(58) Field of Classification Search

CPC ..... F21V 35/00–006; F21W 2121/002; A47G 2400/061; A47G 2200/08

See application file for complete search history.

(56) References Cited

U.S. PATENT DOCUMENTS

| | | | | |
|---|---|---|---|---|
| 2,104,139 | A * | 1/1938 | Sherwood | A47G 19/00 D7/553.6 |
| 2,758,458 | A | 8/1956 | Gan | |
| 9,730,555 | B1 * | 8/2017 | Lee | B65D 43/02 |
| 2008/0241775 | A1 * | 10/2008 | Piemontese | F21V 35/00 431/295 |

(Continued)

FOREIGN PATENT DOCUMENTS

| | | | | |
|---|---|---|---|---|
| FR | 2890153 | A1 * | 3/2007 | A47G 19/00 |

OTHER PUBLICATIONS

Indiegogo, Blowout Pal: The Germ Shield, retrieved from the internet Jul. 20, 2021, <https://www.indiegogo.com/projects/blowout-pal-the-germ-shield#/>.

(Continued)

*Primary Examiner* — Mariceli Santiago

(74) *Attorney, Agent, or Firm* — Bryan Cave Leighton Paisner LLP

(57) ABSTRACT

The present disclosure is directed to improved food protection apparatuses, assemblies, and methods of use. The food protection apparatus includes a base portion; a removable covering coupled to the base portion, the removable covering including a top surface and one or more side walls, the top surface integrally connected to the one or more side walls; and a candle delivery apparatus coupled to the top surface of the removable covering, the candle delivery apparatus including one or more openings to receive one or more candles to position the candles external to the removable covering.

22 Claims, 11 Drawing Sheets

(56) References Cited

U.S. PATENT DOCUMENTS

| | | | | |
|---|---|---|---|---|
| 2009/0181335 | A1* | 7/2009 | Tropeano | F21S 13/14 431/295 |
| 2012/0183629 | A1 | 7/2012 | Dunn | |
| 2012/0247996 | A1 | 10/2012 | Donnelly | |
| 2013/0248402 | A1* | 9/2013 | Donnelly | F21V 35/00 431/295 |
| 2014/0272743 | A1* | 9/2014 | Hill | F21V 35/00 431/295 |
| 2021/0396383 | A1* | 12/2021 | Fuge | F21V 35/00 |
| 2022/0128233 | A1* | 4/2022 | Millington | F21V 35/006 |

OTHER PUBLICATIONS

Blowout Pal, Blowout Pal Helps Families Continue Celebrations Safely Without Spreading Germs During Quarantine and Social Distancing, Mar. 30, 2020.

LessMo Pop Up Food Covers, retrieved from the internet Jul. 20, 2021, <http://www.amazon.com/dp/B07GR67F9H/ref=tsm_1_tp_tc>.

LessMo Pop Up Food Covers, retrieved from the internet Jul. 20, 2021, <https://protect-us.mimecast.com/s/FupXCrkg1Vf9B19EH7wllf>.

* cited by examiner

FOOD PROTECTION APPARATUSES, ASSEMBLIES, AND METHODS OF USE

CROSS-REFERENCE TO RELATED APPLICATIONS

This application claims benefit to U.S. Provisional Patent Application No. 63/043,723 filed on Jun. 24, 2020. The content of the above-identified application is incorporated by reference herein in its entirety.

TECHNICAL FIELD

This disclosure is related to one or more food protection apparatuses, as well as devices, assemblies, systems, and methods of using the same. In some embodiments, the apparatuses may include hygienic or sanitary disposable covers utilized to protect cakes (e.g., birthday cakes having one or more candles) and/or other food items from pathogens, contagions, germs, viruses, and/or other contaminating substances. In some embodiments, the apparatuses may include candle placement and delivery tools that permit candles to be served with cakes and/or other food items in a manner that protects the food items from pathogens, contagions, germs, viruses, and/or other contaminating substances.

BACKGROUND

Normal handling of food items can result in these items being exposed to pathogens, contagions, germs, viruses, and/or other contaminating substances. For example, a food item may be exposed to contaminants when it is delivered, prepared, and/or served. Individuals who ingest food items that have been exposed to contaminating substances can develop various adverse health effects or conditions.

For instance, it is customary to serve a cake to celebrate an individual's birthday (as well as for other reasons), and to have one or more persons blow out candles that are placed onto the cake. Contaminating substances, such as bacteria, viruses and/or germs, may be transmitted to the cake when an individual blows out the candles. Contaminating substances can also be transmitted to the cake by those individuals who prepare, handle, and/or serve the cake.

In recent times, COVID-19 (also known as coronavirus disease 2019) is a virus that has rapidly spread and been the cause of grave impact worldwide. Like many other viruses, COVID-19 can be spread to food items in situations where individuals infected with the virus prepare, handle, serve or otherwise interact with the food items. The COVID-19 pandemic has reinforced the importance of taking proper precautions to avoid spreading contaminants, bacteria, and disease.

Accordingly, there is a need for improved food coverings that can protect food items, such as cakes from contaminating substances, and ensure that the food items are maintained and served in a hygienic and sanitary fashion.

BRIEF DESCRIPTION OF DRAWINGS

The principles are illustrated in the figures of the accompanying drawings, which are meant to be exemplary and not limiting, and in which.

DETAILED DESCRIPTION OF EXEMPLARY EMBODIMENTS

Figure 1:
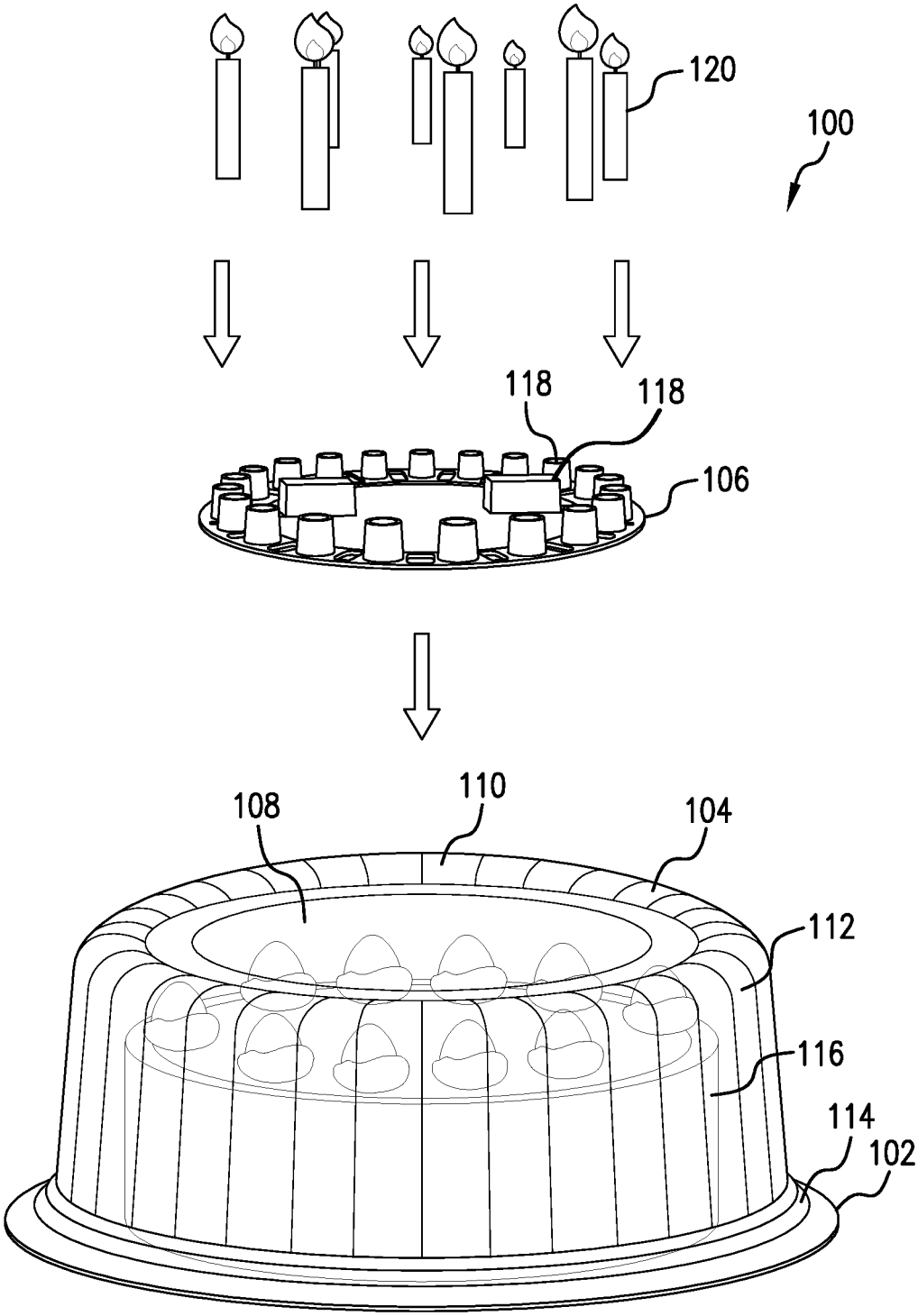
FIG. 1 is an illustration of an exemplary food protection apparatus in accordance with certain embodiments.

The present disclosure relates to improved food protection apparatuses, devices, assemblies, systems, and methods of using the same. In certain embodiments, these may be utilized to prevent or minimize the spread of contaminating substances (e.g., pathogens, contagions, bacteria, germs, viruses, dust, dirt, saliva and other bodily fluids, and/or the like) to food items, such as cakes that are served with candles intended to be blown out during a birthday celebration or other event. The food protection devices, assemblies, systems, and methods described herein can include or utilize additional features that provide other advantages as described in further detail below.

The food protection apparatuses and/or assemblies described herein may include candle delivery apparatuses. In certain embodiments, the food protection apparatuses and/or assemblies also may optionally include a housing structure comprising a removable covering and a base portion that cooperate to form a cavity for protecting food items. The candle delivery apparatuses can to be universally connected to any housing structure and/or removable covering, regardless of the material (e.g., polymers, plastics, cardboard, etc.) and/or shape (e.g., circular, rectangular, square, etc.) that is used to form the housing structure and/or removable covering. The candle delivery apparatuses also can be connected to other structures or items on which it is desired to present candles.

In certain embodiments, the candle delivery apparatuses may be connectable to, or integrated with, the removable coverings. For example, in some cases, bottom surfaces of the candle delivery apparatuses can include connectors (e.g., adhesive connectors) that enable a candle delivery apparatus to be connected to the removable covering and/or other desired structures. During usage, the candle delivery apparatus can be attached to the exterior of the removable coverings to allow for presentation of candles while the removable covering is able to protect the food item inside the cavity from contaminating substances (e.g., such as when an individual blows out the candles included on the candle delivery apparatuses).

Additionally, as explained in further detail below, the structures of the candle delivery apparatuses can be configured to accommodate candles having varying sizes and configurations (e.g., traditional cylindrical birthday candles, candles formed in the shape of letters/numbers, candles having square or rectangular bottom surfaces, thin candles having minimal diameters, candles attacked to skewer or toothpick-like protrusions, etc.). For example, in certain embodiments, the candle delivery apparatuses can include a plurality of protrusions that are adapted to receive candles. The structures of the protrusions can be conically-shaped and can include one or more ribs to facilitate connection of candles having various widths and sizes. Additionally, bottom portions of the protrusions can include a recess for connecting candles that are integrated with skewer or toothpick-type connectors. One or more of the protrusions also can be adapted to accommodate candles that are shaped in letters, numbers, and/or other design forms.

In certain embodiments, the removable covering may include a top surface and one or more side walls. In certain embodiments, the top surface may be integrally connected to the one or more side walls. The base portion may be substantially flat or planar such that it can easily rest on an underlying surface (e.g., a table, counter, tray, etc.). The removable covering can be easily attached and detached from the base portion. For example, the removable covering may serve as a removable lid whereby one or more side walls of the removable covering are capable of being connected to the base portion. During usage of the food protection assembly, a food item may be placed inside a cavity formed within the housing structure when the removable covering is connected to the base portion, thus protecting the food item in the cavity from contaminating substances. In certain embodiments, there may be no base at all and the covering may stand on its own on any flat surface.

Exemplary embodiments of the food protection apparatuses, candle delivery apparatuses, removable coverings, and base portions are described in further detail below.

FIG. 1 is an illustration of an exemplary food protection apparatus 100 in accordance with certain embodiments. The food protection apparatus 100 of the illustrated embodiment includes a base portion 102, a removable covering 104, and a candle delivery apparatus 106 (i.e., a candle delivery system).

In certain embodiments, the base portion 102 can include substantially flat or planar top and bottom surfaces. For example, the base portion 102 can include a planar top surface to provide a level surface that is able to support a food product, a planar bottom surface that allows the base portion 102 to rest on an underlying surface (e.g., a table, counter, or tray). The periphery of the base portion 102 can include a modified edge that comprises a connection mechanism to couple itself to the removable covering 104.

In certain embodiments, the removable covering 104 includes a top surface 108 and one or more side walls 110. In the illustrated embodiment, the top surface 108 is integrally connected to the one or more side walls 110. The removable covering 104 can be coupled to the base portion 102 by a connection portion 114 of the side walls 110. In certain embodiments, the connection portion 114 can include a connection mechanism utilizes press fit fasteners (e.g., such as those used to secure Tupperware™ lids to containers), snap fasteners, hook-and-loop fasteners (e.g., such as Velcro™ fasteners), latching fasteners, button fasteners, zipper fasteners, and/or other connectors to couple the removable covering 104 to the base portion 102. In other certain embodiments, there may be no base portion 102 at all and the removable covering 104 my stand on its own (e.g., form a seal with a table, or other surface different than the base portion 102). In the illustrated embodiment, the removable covering 104 and the base portion 102 define a cavity 112. In certain embodiments, the removable covering 104 and/or the base portion 102 can include micro-perforations to permit fluid (e.g., air) into the cavity 112 to mitigate spoilage of food products 116 positioned in the cavity 112.

In certain embodiments, the removable covering 104 and/or the base portion 102 may be constructed of materials having appropriate porosity to permit sufficient breathability and potential air flow into the cavity 112, and to prevent spoilage of the food products 116 stored therein. For example, in some cases, appropriate porosity may be provided by incorporating micro-perforations into the surfaces of the removable covering 104 and/or the base portion 102. In these cases, the micro-perforations may be large enough to permit air flow and/or oxygen molecules into the cavity 112, but may be small enough to prevent viruses, bacteria, and/or other pathogens from entering the cavity 112.

The sizes, shapes, and opacity of the removable covering 104 and/or the base portion 102 also can be varied. The removable covering 104 and/or the base portion 102 can generally be configured in any shape. For example, the removable covering 104 and/or the base portion 102 can be configured in a circular, dome-like, triangular, rectangular, square, and/or other shape. In certain embodiments, the removable covering 104 and/or the base portion 102 may be constructed in a circular shape that is able to accommodate a circular cake. In certain embodiments, the removable covering 104 may be substantially dome-shaped with a flat upper surface.

Along similar lines, the removable covering 104 and/or the base portion 102 can be fabricated in any size, and the dimensions of the removable covering 104 and/or the base portion 102 can be varied to accommodate food items of different sizes. For example, the removable covering 104 and/or the base portion 102 can be configured in a first size (e.g., approximately 3-6 inches in width, 3-6 inches in length, and 2-4 inches in height) that accommodates smaller food items such as doughnuts, a second size (e.g., approximately 8-15 inches in width, 8-15 inches in length, and 6-10 inches in height) that accommodates items such as birthday cakes, and a third size (e.g., approximately 1-3 feet in width, 1-3 feet in length, and 1-5 feet in height) to accommodate larger food items such as wedding cakes. The removable covering 104 and/or the base portion 102 can be constructed in other sizes and/or dimensions not specifically mentioned herein.

The opacity of the removable covering 104 and/or the base portion 102 also can be varied. In certain embodiments, the removable covering 104 and/or the base portion 102 can be substantially translucent to enable viewing of a food item located within the housing structure. In other embodiments, the removable covering 104 and/or the base portion 102 can be entirely or partially colored to prevent or limit viewing of a food item within the housing structure. In some embodiments, various designs (e.g., logos, pictures, words, paintings, etc.) can be applied to the removable covering 104 and/or the base portion 102.

The configuration of the removable covering 104 and/or the base portion 102 can vary. The removable covering 104 and/or the base portion 102 can generally be constructed of any suitable material. In certain embodiments, the removable covering 104 and/or the base portion 102 can be entirely or partially fabricated from one or more of the following materials: polymers, vinyl, plastics, glass materials, wood materials, foam materials (e.g., Styrofoam™), and/or metals. In certain preferred embodiments, the removable covering 104 and/or the base portion 102 may be constructed of plastics, silicone, vinyl, or polymers. The plastics or polymers may be translucent or transparent and rigid and/or flexible (e.g., such as Saran wrap-like plastics or polymers).

In certain embodiments, the removable covering 104 and/or the base portion 102 may be constructed of materials (e.g., thin plastic, thin plastic film, Saran wrap, paper, cardboard, etc.) that are intended to be disposable after a single use or a limited number of uses. In certain embodiments, the removable covering 104 and/or the base portion 102 may be constructed of materials (e.g., plastics, vinyl, silicone, wood, etc.) that are intended to be reusable. In the latter case, the removable covering 104 and/or the base portion 102 may be constructed of materials that are easily cleanable and/or washable (e.g., such as plastics and/or other materials that can be cleaned in a dishwasher).

In certain embodiments, the removable covering 104 and/or the base portion 102 may be treated with one or more decontaminating substances. The decontaminating substances can include any substance that can assist with disinfecting, sterilizing, and/or sanitizing the removable covering 104 and/or the base portion 102. The decontaminating substances applied to the removable covering 104 and/or the base portion 102 may include decontaminating substances that are do not cause adverse health conditions in the event they are ingested.

In the illustrated embodiment of FIG. 1, the candle delivery apparatus 106 (e.g., candle delivery system) is coupled to the top surface 108 of the removable covering 104. The candle delivery apparatus 106 includes one or more openings 118 to receive one or more candles 120 to position the candles 120 external to the removable covering 104. In particular, the candle delivery apparatus 106 includes the one or more openings 118 to position the candles external to the cavity 112 to protect the food products 116.

In certain embodiments, the candle delivery apparatus 106 may permit one or more candles 120 to be inserted into a food item (e.g., such as a cake) located within the cavity 112. During usage, the removable covering 104 is able to protect the food item inside the cavity 112 from contaminating substances (e.g., germs, viruses, pathogens, bacteria, saliva, etc.), such as when an individual blows out the candles 120 inserted into the food item or the food item is being delivered, served, and/or handled by individuals.

The configuration of the candle delivery apparatus 106 can vary. In certain embodiments, the candle delivery apparatus 106 can include one or more openings 118 that are included on the top surface 108 of the removable covering 104 and which extend through the top surface 108 to provide access to the cavity 112 within the removable covering 104. In certain embodiments, the openings 118 may include pre-cut and/or pre-fabricated openings that are included on the removable covering 104 when it is manufactured. That is, the candle delivery apparatus 106 can be formed in the top surface 108 of the removable covering 104. Alternatively, or additionally, all or a portion of the top surface 108 may be constructed of a material that can be easily punctured by an individual to create the openings as desired. For example, in some cases, the top surface 108 may include one or more designated portions that are thinner (and easier to puncture) than other portions of the top surface 108 to enable insertion of candles 120. In some cases, the one or more designated portions may alternatively, or additionally, be perforated to further assist with insertion of the candles.

Generally speaking, any number of openings 118 may be included (e.g., 1 hole, 5 holes, 20 holes, 50 holes, 100 holes, etc.) on the removable covering 104. The openings 118 can be sized to accommodate candles 120 having any size and/or shape. For example, in certain cases, the openings 118 can include small circular holes that have a diameter slightly larger than the width of traditional candles (e.g., 0.2-0.5 inches). In scenarios involving candles having larger widths (e.g., in scenarios where candles are shaped into numbers or letters), the diameters of one or more openings 118 can be wider (e.g. 0.75-2 inches) to accommodate the increased width of the candles. Additionally, it should be noted that each of the food protection assemblies may include multiple openings that have different sizes. For example, an exemplary food protection assembly may include a relatively large central opening that can accommodate large candles (e.g., candles shaped into numbers or letters), as well as a plurality of smaller openings for accommodating a plurality of traditional birthday candles.

Figure 2:
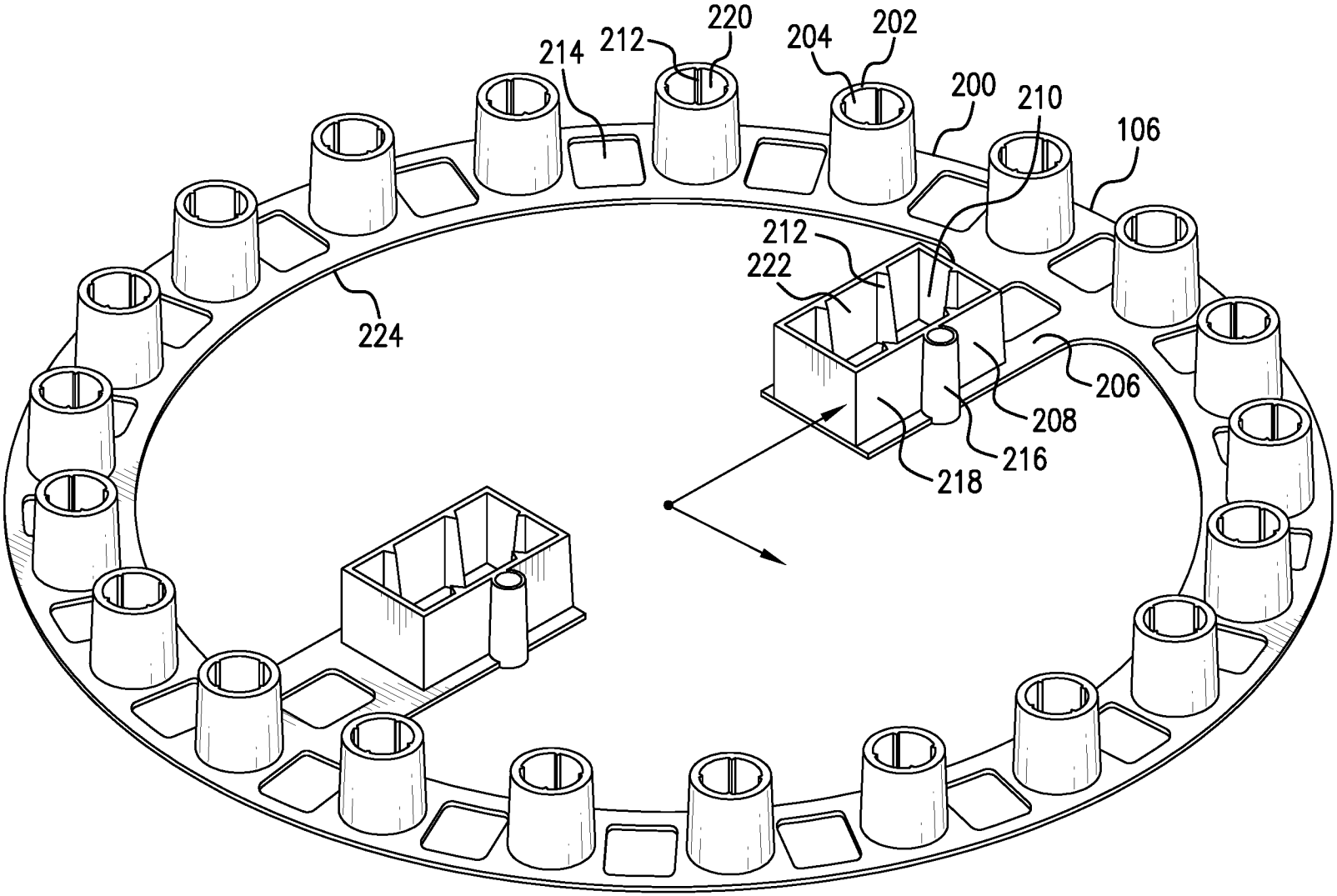
FIG. 2 is an illustration of an exemplary candle delivery apparatus in accordance with certain embodiments.

Turning to FIG. 2, an exemplary candle delivery apparatus 106 is shown. The candle delivery apparatus 106 includes one or more peripheral protrusions 202 (e.g., twenty one peripheral protrusions) included on a peripheral surface 200 and one or more internal protrusions 208 (e.g., two internal protrusions 208) included on one or more internal surface 206. Each peripheral protrusion 202 includes a first recess 204 and an internal surface 206. Each internal protrusion 208 includes a second recess 210 and one or more ribs 212. The peripheral surface 200 can include apertures 214 located between the peripheral protrusions 202, and the peripheral surface 200 can be connected to and/or integrally with the internal surfaces 206.

In the exemplary embodiment of FIG. 2, the peripheral protrusion 202 and the internal protrusion 208 operate in the same or similar manner as the openings 118 in FIG. 1. In the illustrated embodiment of FIG. 2, the peripheral surface 200 is shown as circumferential. However, the peripheral surface 200 may take on any shape. For example, the peripheral surface 200 may take the shape of a rectangle, triangle, rhombus, etc. In certain embodiments, the internal surface 206 can be integrally formed with the peripheral surface 200. That is, the internal surface 206 and the peripheral surface 200 can form a uniform structure.

The placement and structures of the peripheral protrusions 202 and the internal protrusions 208 may be modified based on particular design elements. For example, while the structure and appearance of the protrusions 202, 208 are depicted as in circular/conical and rectangular shapes in the figures, the protrusions can be manufactured to form different shapes (e.g., the shape of a baseball, wand, balloon, and/or any type of shape based on a request of a customer). For ease of description, the candle delivery apparatus 106 will be described with reference to the shape illustrated in FIG. 2.

In the illustrated embodiment, the apertures 214 separate the peripheral protrusions 202 and the internal protrusions 208 from each other. However, in certain embodiments, the apertures 214 are not formed in the candle delivery apparatus 106, thereby creating a uniform peripheral surface 200. In the illustrated embodiment, the apertures 214 may receive corresponding protrusions on the top surface 108 of the removable covering 104 or any type of connection mechanism on another surface to maintain the stability of the candle delivery apparatus 106 and/or facilitate connection of the candle delivery apparatus 106 to the removable covering 104.

In the illustrated embodiment, the first recess 204 of the peripheral protrusion 202 has a first shape configured to receive a first type of candle (e.g., a candle having a circular or cylindrical shaped bottom surface), and the second recess 210 of the internal protrusion 208 has a second shape different from the first shape that is configured to receive a second type of candle (e.g., a candle having a square or rectangular shaped bottom surface). In the illustrated embodiment, the peripheral protrusion 202 includes ribs 212 on an internal surface 220 of the first recess 204, and the internal protrusion 208 includes ribs 212 on an internal surface 222 of the second recess 210. During operation, the first recess 204, the second recess 210, and the ribs 212 maintain the candles 120 in an upright position and mitigate the candles 120 from moving during transport of the candle delivery apparatus 106, and accommodate various diameters of candles including standard candles, thicker candles, and even candles affixed to very thin skewer or toothpick-like sticks. For example, the first recess 204 and the second recess can be sized to provide stability to a lower portion of the candles 120, and the ribs 212 are sized to indent a lower portion of the candles 120 (e.g., to form in the wax of the candle) to mitigate the candles 120 from moving.

In certain embodiments, the internal protrusion 208 also can include one or more circumferential protrusions 216 formed on an external surface 218 of the internal protrusion 208. In some cases, bottom portions of candles 120 can include a stick, connector, or extension that extends outwardly from a bottom surface of the candle (e.g., which may traditionally be inserted into a cake or food item). The stick, connector, or extension can be inserted into the internal protrusion 208 to permit these types of candles to be connected to the candle delivery apparatus 106. Additionally, or alternatively, the peripheral protrusions 202, the internal protrusions 208, and/or the circumferential protrusions 216 can receive other apparatuses (e.g., sparklers, signs, pinwheels, etc.) in addition to candles 120.

The candle delivery apparatus 106 of the illustrated embodiment includes a bottom surface 224. In certain embodiments, the bottom surface 224 includes a connection mechanism for coupling the candle delivery apparatus 106 to a surface (e.g., the top surface 108 of the removable covering 104). The configuration of the connection mechanism can vary.

For example, in some cases, the connection mechanism can include the apertures 214, an adhesive strip positioned on the bottom surface 224 (e.g., that includes a surface that can be peeled away to provide access to an adhesive), putty material, and/or any other materials that can assist with connecting the structure to a covering. In certain embodiments, the bottom surface 224 of the platform structure may not include an adhesive connector, but the structure may be attached to a covering using an adhesive (e.g., tape, glue, bonding materials, etc.).

In certain embodiments (e.g., such as those in which the removable covering is substantially dome-shaped with a flat upper surface), the flat upper surface may be equipped with the platform structure and/or any of the candle delivery apparatuses described herein. Further, the connection mechanism on the bottom surface 224 may include press fit fasteners (e.g., such as those used to secure Tupperware™ lids to containers), snap fasteners, hook-and-loop fasteners (e.g., such as Velcro™ fasteners), latching fasteners, button fasteners, zipper fasteners, etc.

Figure 3:
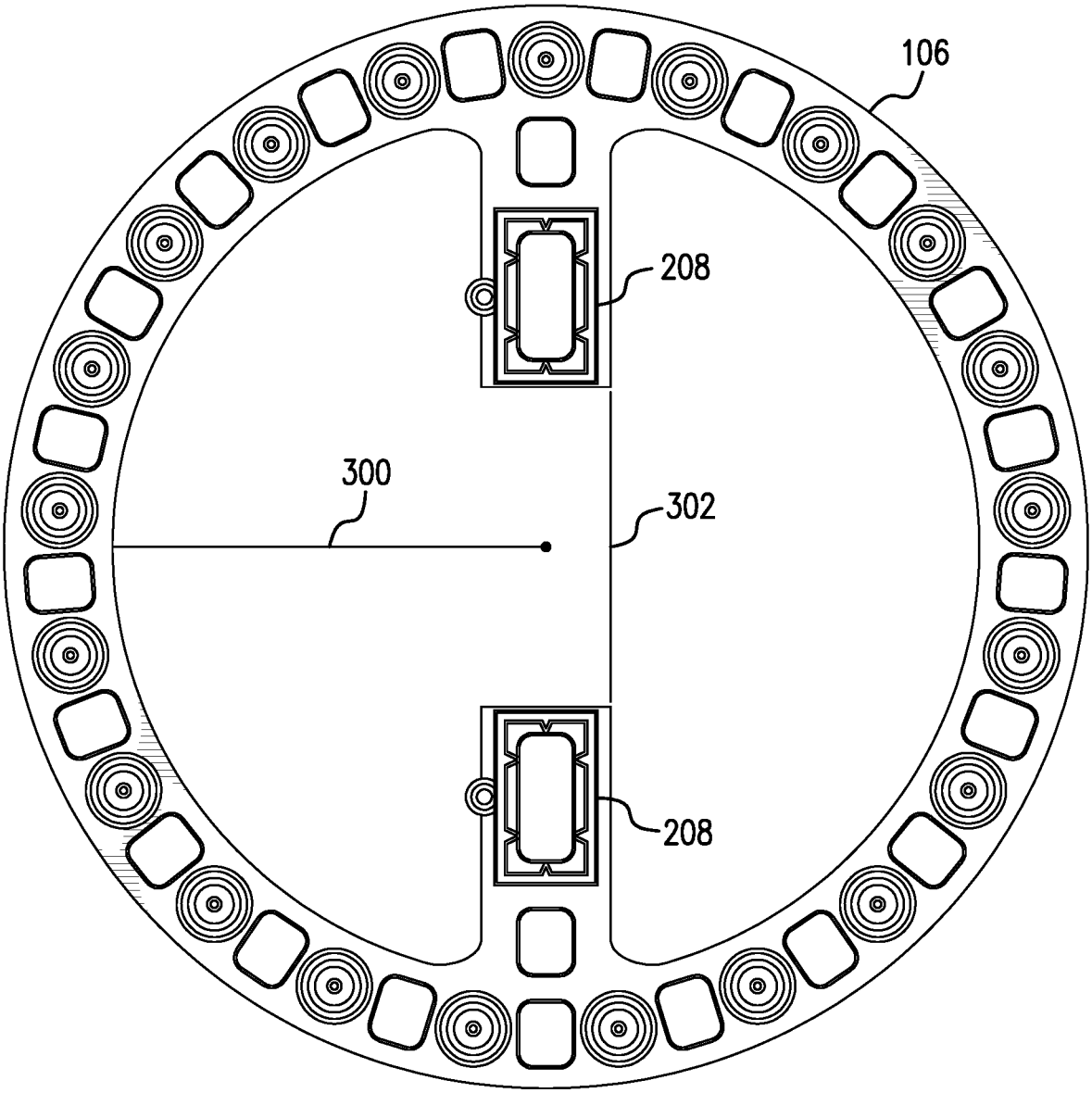
FIG. 3 illustrates a top view of the exemplary candle delivery apparatus in accordance with certain embodiments.

FIG. 3 illustrates a top view of the exemplary candle delivery apparatus 106. In the illustrated example, the candle delivery apparatus 106 has a radius 300. In certain embodiments, the radius 300 is sized based on a top surface 108 of the removable covering 104. In the illustrated embodiment, the internal protrusions 208 are spaced apart a distance 302. In certain embodiments, the distance 302 can be increased or decreased based on design elements and/or the size of the top surface 108 of the removable covering 104.

Figure 4:
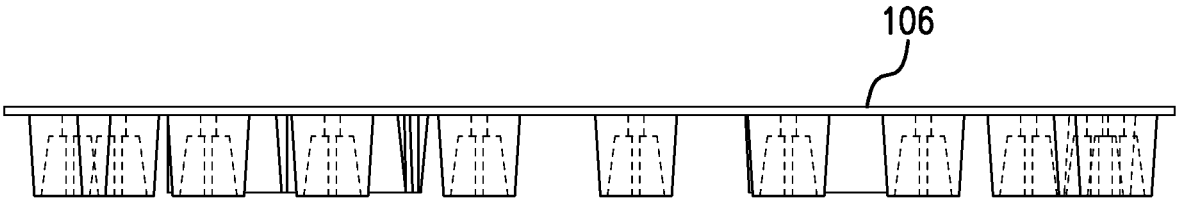
FIG. 4 illustrates a side view of the exemplary candle delivery apparatus in accordance with certain embodiments.

FIG. 4 illustrates a side view of the exemplary candle delivery apparatus 106. This view demonstrates the first recesses 204 extending into the peripheral protrusions 202 and the second recesses 210 extending into the internal protrusions 208.

Figure 5:
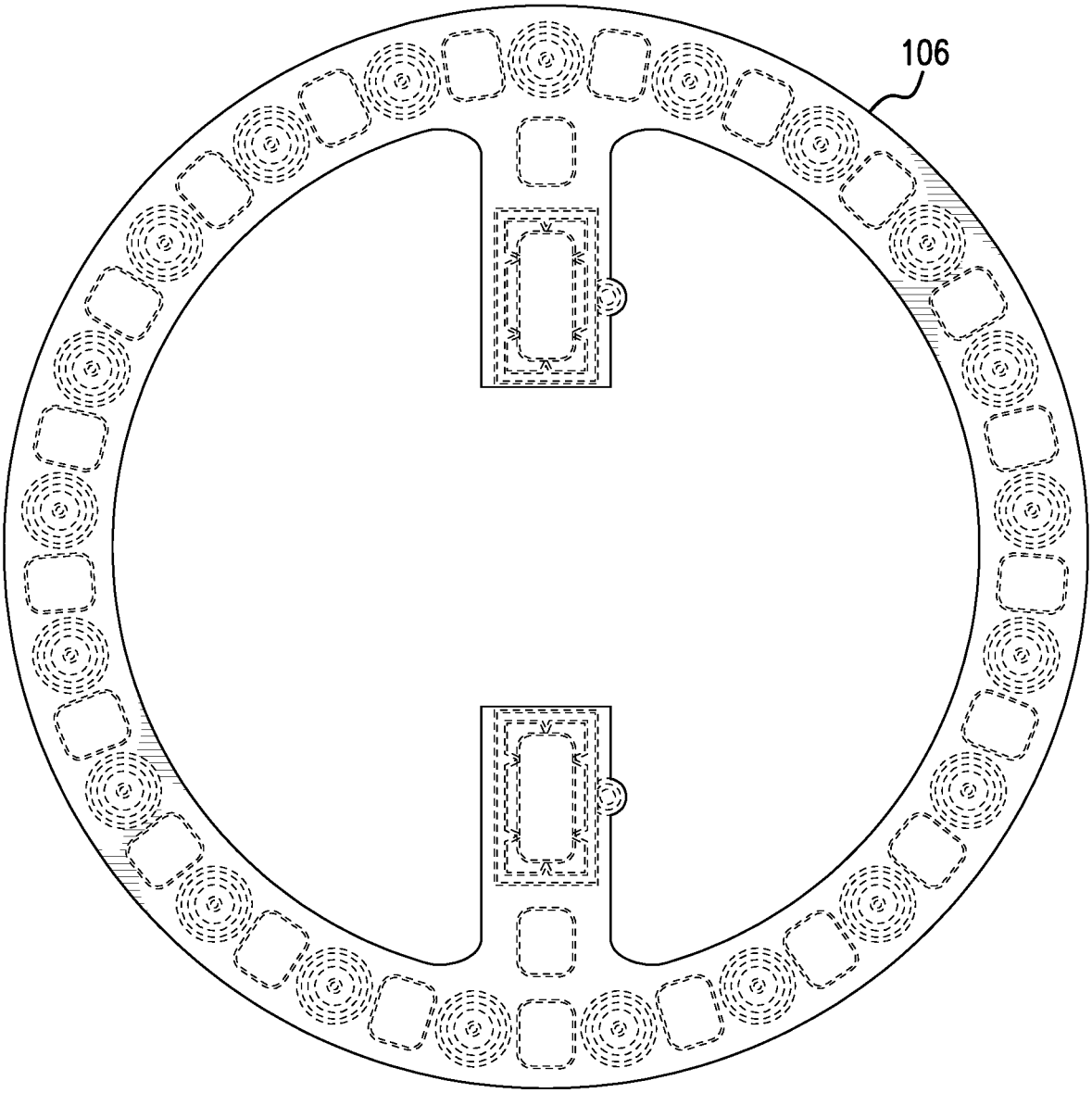
FIG. 5 illustrates a bottom view of the exemplary candle delivery apparatus in accordance with certain embodiments.

FIG. 5 illustrates a bottom view of the exemplary candle delivery apparatus 106. As mentioned above, the bottom surface 224 of the candle delivery apparatus 106 can include or be equipped with one or more adhesive connectors that facilitate connection of the candle delivery apparatus 106 to the removable cake covering 104. The adhesive connectors can be located on any portion of the bottom surface 224 (e.g., on the bottom portions of the peripheral surface 200 and one internal surfaces 206).

Figure 6:
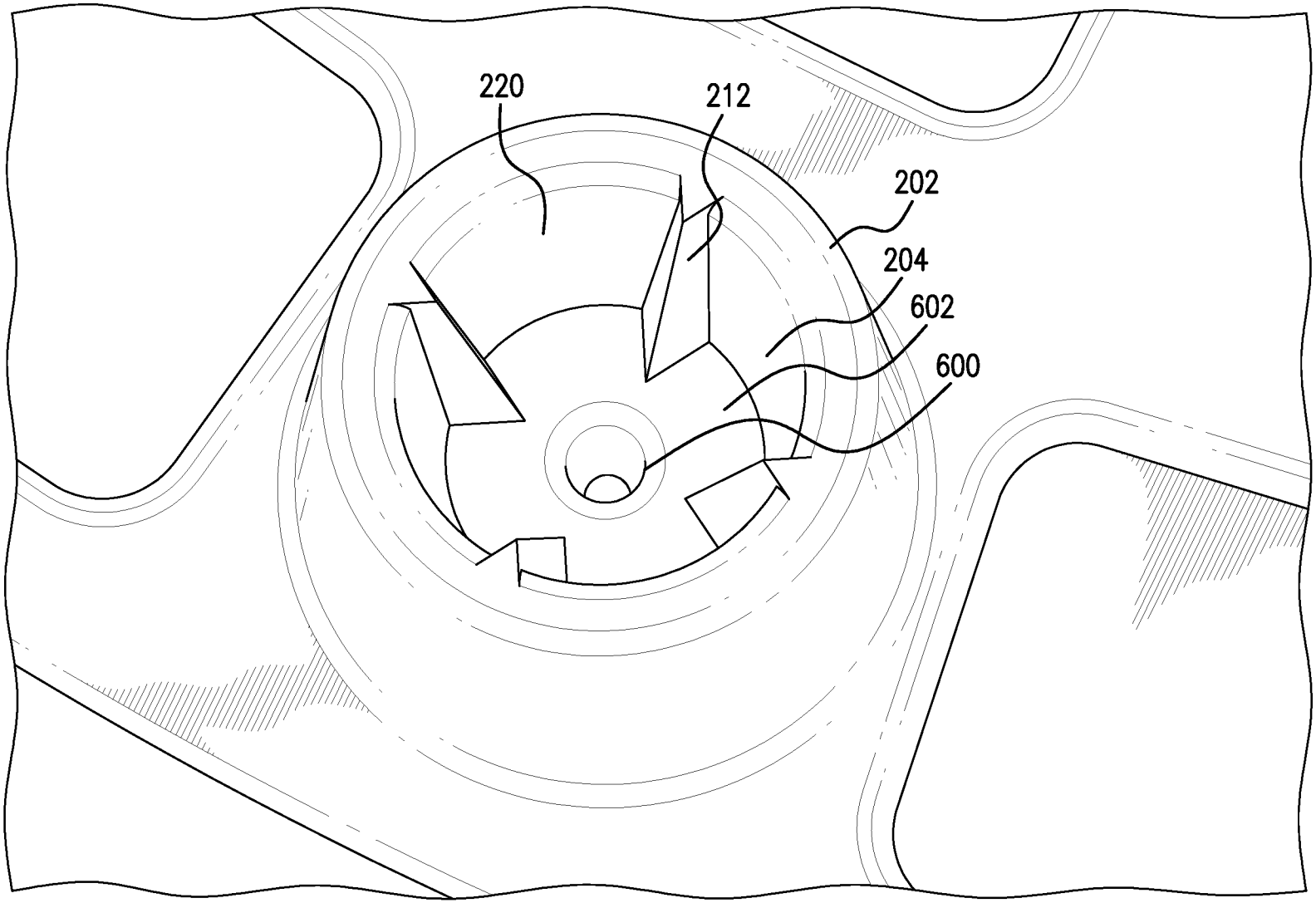
FIG. 6 illustrates an exemplary peripheral protrusion in accordance with certain embodiments.

FIG. 6 illustrates an exemplary configuration for a peripheral protrusion 202. The peripheral protrusion 202 includes a third recess 600 on a bottom surface 602 of the peripheral protrusion 202. In the illustrated embodiment, the third recess 600 has a third shape (e.g., a circular or cylindrical shape) that is smaller than the first and second shapes. The third recess 600 can facilitate connection of additional types of candles (e.g., candles having a smaller circumference or perimeter). For example, the third recess 600 can receive candles 120 that are sized small enough to avoid the ribs 212, and these candles can be pressed fitted into the third recess 600.

Figure 7:
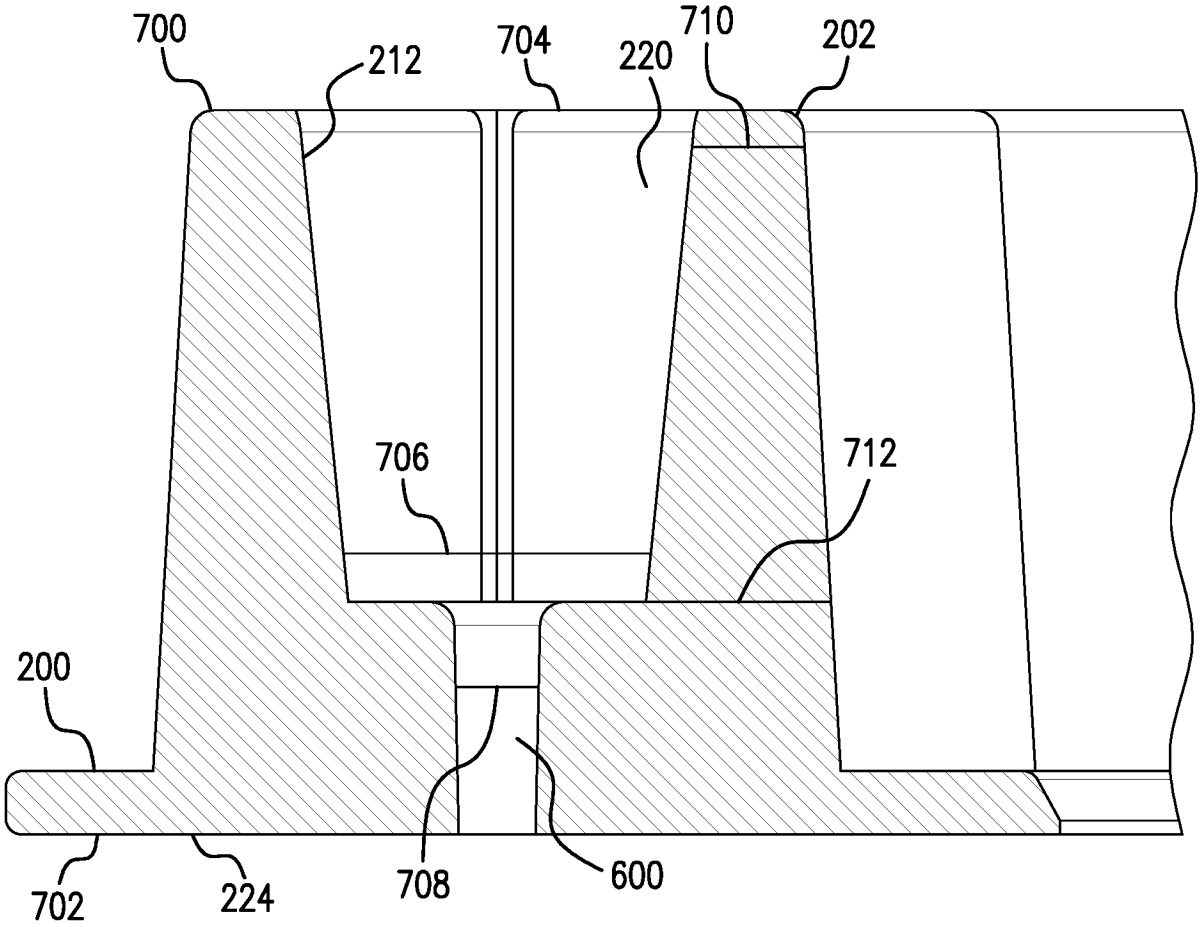
FIG. 7 illustrates a cross section of the peripheral protrusion in accordance with certain embodiments.

FIG. 7 illustrates a cross section of the peripheral protrusion 202. In the illustrated embodiment of FIG. 7, the peripheral protrusion 202 has a first end 700 and a second end 702. In certain embodiment, the first end 700 and the second end 702 can be spaced apart based on desired design elements (e.g., a desired depth of the recess 204). In the illustrated embodiment, the first end 700 of the peripheral protrusion 202 has a first size 704 (e.g., a first diameter) and a second end 207 has a second size 706 (e.g., a second diameter) that is larger than the first size 704. The interior walls of the recess can be shaped conically, such that the walls are narrow towards the bottom of the recess. This can assist with press fitting or connecting candles into the recess, and allows the peripheral protrusion 202 to accommodate candles of various sizes and shapes.

The recess 600 of the illustrated embodiment includes a third size 708 (e.g., a third diameter) that is smaller than the first size 704 and the second size 706. In the illustrated embodiment, the rib 212 has a first size 710 adjacent to the first end 700 and a second size 712 different than the first size 710 adjacent to the second end 702. In certain embodiments, the rib 212 decreases in size as the rib 212 extends outward from the internal surface 220 towards the third recess 600. That is, the rib 212 forms a blade-type shape to assist in penetrating a surface of the candles 120 to mitigate movement of the candles 120.

Figure 8:
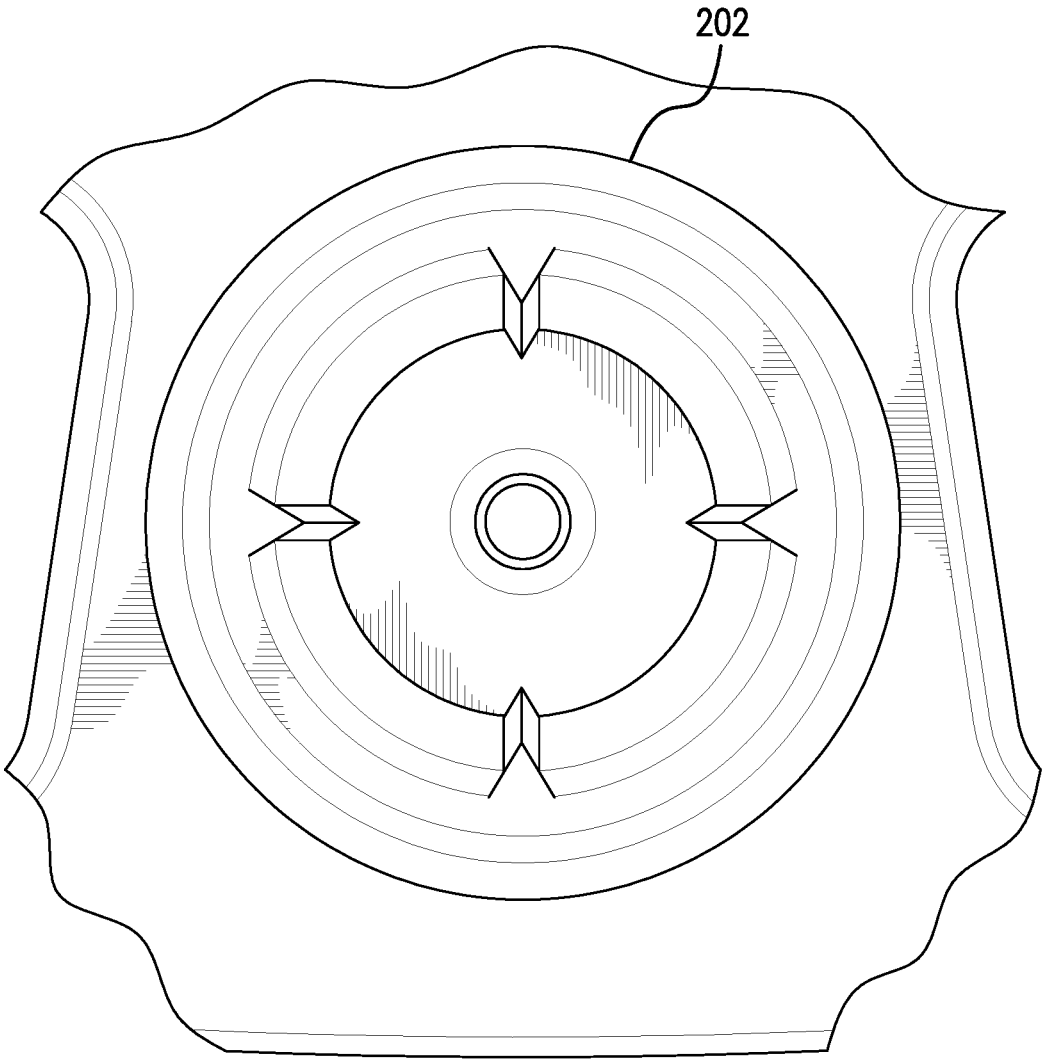
FIG. 8 illustrates a top view of the exemplary peripheral protrusion in accordance with certain embodiments.

FIG. 8 illustrates a top view of the exemplary peripheral protrusion 202.

Figure 9:
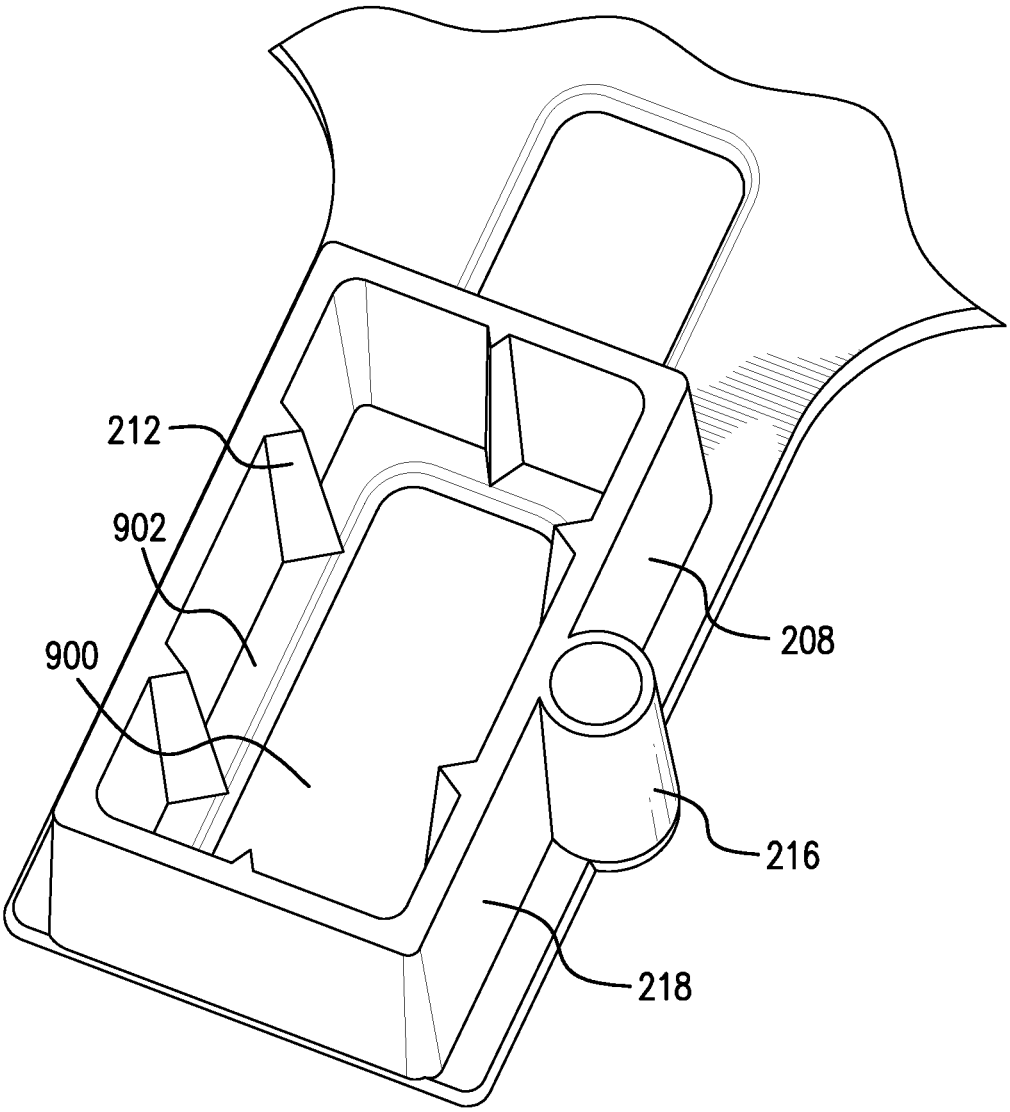
FIG. 9 illustrates an exemplary internal protrusion in accordance with certain embodiments.

FIG. 9 illustrates the exemplary internal protrusion 208 including the circumferential protrusion 216 on the external surface 218 of the internal protrusion 208. In the illustrated embodiment, the internal protrusion 208 includes an opening 900 on a bottom surface 902 of the internal protrusion 208. In some cases, the opening 900 can enable certain types of candles (e.g., candles having a square and/or rectangular bottom surfaces) to be press fitted and/or connected to the internal protrusion 207. In certain embodiments, the bottom surface 902 can include a contiguous and uniform surface that does not include the opening 900. In the illustrated embodiment, the internal protrusion includes six ribs 212. However, any number of ribs 212 can be used based on design preferences.

Figure 10:
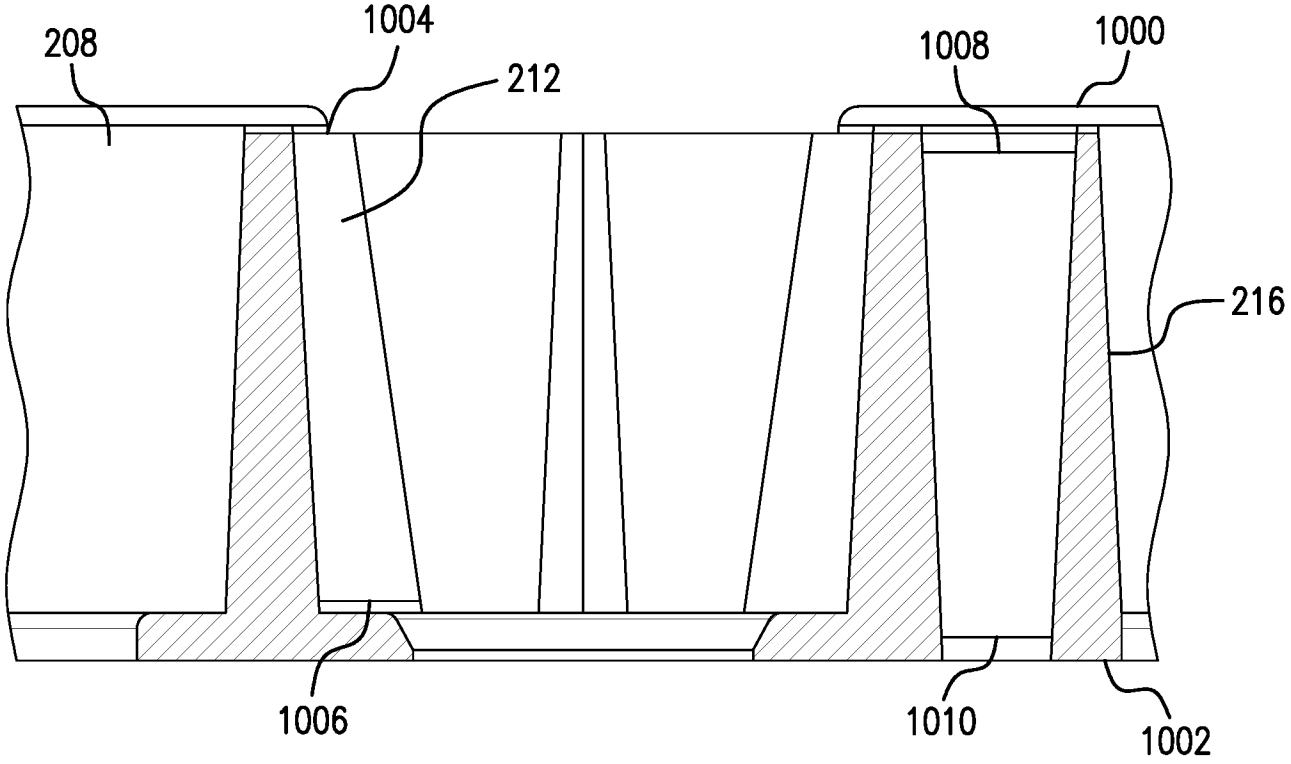
FIG. 10 illustrates a cross section of the internal protrusion in accordance with certain embodiments.

FIG. 10 illustrates a cross section of the internal protrusion 208. In the illustrated embodiment of FIG. 10, the internal protrusion 208 has a first end 1000 and a second end 1002. In certain embodiments, the first end 1000 and the second end 1002 can be spaced apart based on desired design elements (e.g., a desired depth of the recess 210). In the illustrated embodiment, the ribs 212 have a first size 1004 adjacent to the first end 1000 and a second size 1006 different than the first size 1004 adjacent to the second end 1002. In certain embodiments, the rib 212 decreases in size as the rib 212 extends outward from the internal surface 222 towards the opening 900. That is, the rib 212 forms a blade-type shape to assist in penetrating a surface of the candles 120 to mitigate movement of the candles 120. In the illustrated embodiment, the circumferential recess 216 has a first size 1008 (e.g., a first diameter) adjacent to the first end 1000 and a second size 1010 (e.g., a second diameter) different than the first 1008 adjacent to the second end 1002.

Figure 11:
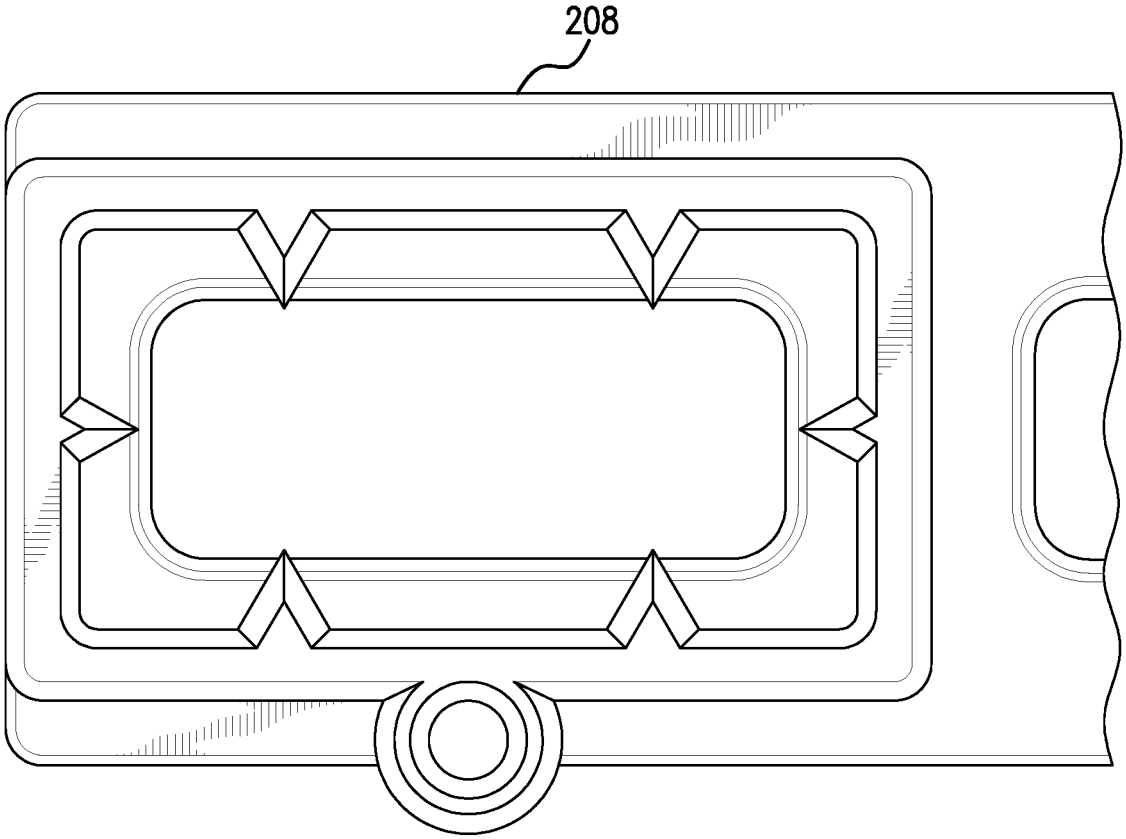
FIG. 11 illustrates a top view of the exemplary internal protrusion in accordance with certain embodiments.

FIG. 11 illustrates a top view of the exemplary internal protrusion 208.

FIGS. 1-11 illustrate exemplary embodiments of food protection apparatuses and related features. It should be recognized that food protection apparatuses can be modified in many ways. In some cases, the food protection apparatuses can be equipped with other features not explicitly mentioned above. Additional details are provided below describing other embodiments and features of the food protection apparatuses.

In certain embodiments, the candle delivery apparatuses can include an adjustment mechanism that enables the sizes and/or diameters of the openings to be varied. For example, a candle delivery apparatus can include a rotatable dial or tab that permits an individual to customize the sizes of the one or more openings or recesses that facilitate connection of candles. Other types of adjustment mechanisms may also be utilized to vary the size of the openings.

In certain embodiments, the candle delivery apparatus can include a sealing mechanism for sealing one or more openings or recesses associated with the candle delivery apparatus. For example, in situations where the candle delivery apparatus includes more openings than the number of candles being used, the sealing mechanism may be used to seal, or close access to, the openings that are not receiving candles. In some embodiments (e.g., such as those in which the openings or recesses extend into the removable covering), the sealing mechanism can further protect the food item inside the housing structure from contaminating substances that may be transmitted via the unused or unoccupied openings.

The configuration of the sealing mechanisms can vary. In some embodiments, the sealing mechanism may include plugging structures which may be inserted into any openings that are not receiving candles. Alternatively, or additionally, the sealing mechanism may include adhesive strips that can be applied to cover the openings. Alternatively, or additionally, the sealing mechanism may include rotatable tabs that can be used to seal or close off the openings. For example, each opening may be outfitted with a tab that can be rotated between an open position (which enables candles to be inserted into the openings) and a closed position (which closes access to the opening and prevents candles from being inserted into the opening). Other types of sealing mechanisms can also be used.

Additionally, the candle delivery apparatuses can be integral with the food apparatuses in some cases and/or can be a separate component that is attached to coverings (e.g., such as the removable coverings described herein and/or other typical cake or food item coverings). For example, as described above, rather than integrating the candle delivery apparatuses directly into the structure of the coverings, the candle delivery apparatuses can be connected or attached to the coverings. In some cases, these candle delivery apparatuses can universal in the sense that they can be used with any existing coverings for items of any and all sizes and shapes.

In certain embodiments, the candle delivery apparatuses may be a separate piece of flat plastic or other material, in other words a standalone accessory. It may come in a variety of shapes and sizes but commonly in the form of a circular disk that contains candle holding holes or nubs, is that can either packaged by itself or together with the entire food protection apparatus. In certain embodiments, when this candle holding piece/accessory is packaged as a separate part of the entire system, it can be made out of material that is flexible (so that it may be rolled up) or rigid (like a plastic disk) and adhered to any plastic lid covering (standard or custom) found in the market place, thereby allowing this separate piece to serve as accessory to existing generic lids or coverings that can be used for the explicit purpose of adding a candle lighting/extinguishing element to any of the aforementioned standard devices that do not have a candle holding/lighting feature. Incidentally, this separate candle holding piece may be made of some flame retardant plastic so as to shield the generic plastic lids to which it is adhered from flames, heat or hot wax from the candles.

In certain embodiments, the candle delivery apparatus can comprise a malleable putty-like material (e.g., which has a dough-like consistency) and/or a soft adhesive onto which candles could be embedded or pressed. The putty-like materials may be pressed onto a top surface of the coverings and candles may be inserted into the putty-like material.

In some cases, the candle delivery apparatus may further include candle holders that are connected to a covering using a putty-like material. The candle holders may generally include any structure that is capable of receiving or securing a candle and/or capable of holding a candle in an upright position. For example, a candle holder may comprise a hollow cylinder shape structure that includes a recess for receiving a candle. A top end of the structure may be open to receive the candle and the bottom end may be closed with a wall structure. The putty-like material may be applied to the bottom end and may serve as an adhesive for connecting the candle holder to a covering (e.g., a top surface of a covering).

In another example, the candle delivery apparatus can comprise a platform structure that includes pre-installed candle holders/nubs and/or pre-cut holes for receiving candles, and the platform structure can be attached to a covering (e.g., the removable coverings described herein or traditional food coverings) using an adhesive connector. In certain embodiments, the platform structure may be constructed of one or more flame retardant materials and can be configured in any shape (e.g., square, rectangle, circle, triangle, etc.). In some cases, the platform structure may be embodied in a small box-like structure and/or a pad-like structure which can be adhered and/or connected to the covering. In other cases, the platform structure can be embodied in a sticker-like configuration that includes pre-cut holes and/or candle holders for receiving candles.

In certain embodiments, a top surface of the platform structure may include the pre-installed candle holders and/or pre-cut holes. The top surface can additionally, or alternatively, be covered in plastic nubs, pegs or blades that create a surface into which candles could be pressed and held in position. A bottom surface of the platform structure may include a pre-installed adhesive connector. The adhesive connector may include an adhesive strip (e.g., that includes a surface that can be peeled away to provide access to an adhesive), putty material, and/or any other materials that can assist with connecting the structure to a covering. In certain embodiments, the bottom surface of the platform structure may not include an adhesive connector and the structure may be attached to a covering using any traditional adhesive (e.g., tape, glue, bonding materials, etc.). In certain embodiments (e.g., such as those in which the removable covering is substantially dome-shaped with a flat upper surface), the flat upper surface may be equipped with the platform structure and/or any of the candle delivery apparatuses described herein.

In a further example, the candle delivery apparatus can include a candle extender structure that can be used to serve candles with a food item. The candle extender structure may serve as a standalone structure that rests on an underlying surface on which a food item is being served. The configuration of the candle extender structure can vary.

In some cases, the candle extender structure may include a support structure that is intended to be placed on a surface to support the candle extender structure. In certain embodiments, the support structure may be substantially thin or flat such that it can be placed beneath a food item (e.g., cake) and/or base portion of a food protection apparatus. The weight of the cake and/or food protection apparatus can assist with holding the candle extender structure in place when in use.

The candle extender structure may further include a platform structure (e.g., such as the platform structure described above) that includes pre-installed candle holders and/or pre-cut holes for receiving candles. The platform structure may be connected to the support structure by an intermediary extension arm. In some embodiments, one end of the extension arm is connected to the platform structure and another end of the extension arm is connected to the support structure.

In some cases, the extension arm may be arranged in a U-shape that permits the platform structure to be placed over a food item (and situated above the support structure). In some cases, the extension arm may be arranged substantially perpendicular to the support structure which rests on an underlying surface. The extension arm can be arranged in other configurations as well.

The extension arm may be moveable and adjustable to permit an individual to manipulate and adjust the location, orientation, and/or height of the platform structure and/or candles included in the platform structure. The extension arm may permit the platform structure to be moved to any desired location. For example, in some cases, the movable extension arm may permit an individual to rotate or move the platform structure away from an immediate vicinity of a food item (e.g., to avoid a user blowing candles out over the food item). In some cases (e.g., possibly where a food covering is placed over the item), the extension arm can be rotated or moved such that the platform structure including the candles is placed directly above a food item.

In certain embodiments, the food protection assemblies can include one or more housing adjustment features that enable the sizes of the housing structures, including the removable coverings and base portions, to be expanded and retracted. The housing adjustment features can be beneficial because they permit the food protection assemblies (include the cavities inside the food protection assemblies) to be adjusted to accommodate food items of different sizes.

The configuration of the housing adjustment features can vary. In certain embodiments, the housing adjustment features may include mechanical components that enable a top surface of the base portion to be expanded and retracted, and to be considered "collapsible" and/or compressible. For example, the housing adjustment features may include components that enable the width and/or length/diameter of the top surface to be expanded and retracted (e.g., such as foldable or retractable outer perimeters, telescoping surfaces, umbrella-like pop-up expandability and retraction rods, adjustable track structures that allow for expansion/retraction, etc.). The housing adjustment features may utilize the same or similar mechanical components to facilitate expansion and retraction of the width and/or length of the removable covering.

The removable covering may also be outfitted with one or more housing adjustment features that enable the height of the removable covering to be expanded and retracted (e.g., accordion-like expanders, spiral spring-like rings, collapsible legs, etc.). The housing structure (including the removable covering and/or base portion) can also be collapsible meaning that the sides of the covering may be foldable, bendable or otherwise malleable in a way that allows the housing structure to be compressed for packaging, storing and shipping purposes and be reusable nonetheless. In certain embodiments, the collapsibility of the covering may be accomplished by disassembling the covering into separate pieces, namely a (1) cylindrical siding piece that can be rolled and fastened to form the siding and unfastened and unrolled for storage and packaging for reduced space; (2) a plastic top that can also be folded or rolled up to reduce the size when being stored or packaged; and (3) a separate piece that holds candles that gets snapped onto, adhered to, or is otherwise connected to the top of the covering during assembly.

In certain embodiments, the covering can be in the shape of dome that is expanded or contracted in a manner similar to how an umbrella is expanded and retracted. Also like an umbrella, this dome would be made of a thin vinyl or plastic that can be easily collapsed, rolled and fastened into a single cylinder for dramatic storage reduction. The dome would also serve as a guard against contaminants or germs during the candle lighting/extinguishing process.

In certain embodiments, the food protection assemblies can be outfitted with one or more space-saving features, including but not limited to those specifically outlined herein, that enable the food protection assemblies to be easily stored when they are not being used. Generally speaking, the space-saving features may include any feature that can reduce the width, length, and/or height of the food protection assemblies and/or which other reduce the sizes of the food protection assemblies to facilitate compact storage of the food protection assemblies. In some cases, there may be overlap between the housing adjustment features and the space-saving features, and the same features can serve to perform both roles.

The configurations of the space-saving features can vary. The space-saving features may be integrated into the base portions and/or removable coverings. In certain embodiments, the removable coverings may include a spacing-saving feature that enables the side walls of the removable coverings to be collapsed, thus enabling the height of the removable coverings to be reduced or minimized. For example, the side walls may be supported by one or more collapsible leg structures and/or expandable accordion structures that enable the removable coverings to be collapsed into a space-saving configuration. Additionally, or alternatively, the removable coverings may include one or more space-saving features that enable the removable coverings to be folded, thus reducing the width and/or length of the removable coverings. For example, the removable coverings may include one or more hinges, one or more flexible joints, and/or other similar structures that permit the removable coverings to be folded into space-saving configurations.

The same of similar space-saving features may also be incorporated into the base portions of the food protection assemblies. For example, in certain embodiments, the base portions may include one or more space-saving features (e.g., one or more hinges, one or more flexible joints, and/or other similar structures) that enable the base portions to be folded into space-saving configurations. Depending upon the height of the base portions, the base portions may also one or more space-saving features (e.g., one or more collapsible leg structures and/or expandable accordion structures) that enable side walls of the base portions to be collapsed into space-saving configurations.

In certain embodiments (e.g., such as those in which include the removable covering is substantially dome-shaped with a flat upper surface), the removable covering may include a space-saving configuration that enables the removable covering to be quickly and easily compacted by folding and/or twisting the removable coverings into a compacted configuration (e.g., a flat or substantially flat configuration). The outer perimeter of the removable covering may have a rim that includes a deformable rod (e.g., a fiberglass rod) and which permits the removable covering to be twisted into a compacted state. The removable covering can also have a "pop open" mechanism that enables the removable covering to be quickly and easily converted from a compacted configuration to a usable configuration (e.g., an expanded configuration that permits the removable covering to be deployed and used as a food covering). When configured in the compacted configuration, an individual can convert the removable covering to the usable configuration simply by untwisting the deformable rod and the deformable rod will automatically cause the removable covering to expand into the usable configuration.

The food protection assemblies described herein can be utilized to in connection with any type of food item including, but not limited, to pastries, cakes, meats, vegetables, fruits, snacks, etc. Thus, while certain portions of this disclosure may describe the food protection assemblies as being utilized for protecting cakes or similar food items, it should be understood that such is not necessary and that the food protection assemblies can be utilized with other types of food items.

It should be noted that any feature and/or aspect described for an embodiment discussed herein can be incorporated into, or combined with, any other embodiment described herein. Moreover, it should be noted that none of the features (e.g., such as the candle delivery apparatus, connection mechanisms, sealing mechanisms, hole adjustment mechanism, housing adjustment features, and/or space-saving features) described herein are essential, and any of the features can be omitted from the food protection assemblies. Moreover, one of ordinary skill in the art would recognize that the shapes, configurations, and/or structures of the food protection assemblies can vary, and that the components of the assemblies can be configured in other arrangements.

An example food protection apparatus disclosed herein includes a base portion; a removable covering coupled to the base portion, the removable covering including a top surface and one or more side walls, the top surface integrally connected to the one or more side walls; and a candle delivery apparatus configured to be coupled to the top surface of the removable covering, the candle delivery apparatus including: a peripheral surface comprising a top side and a bottom side, wherein the top side of the peripheral surface includes a plurality of peripheral protrusions, each of the plurality of peripheral protrusions having a first shape configured to receive a first type of candle and each of the plurality of peripheral protrusions including a first recess and one or more ribs; and at least one internal surface including an internal protrusion, the internal protrusion including a second recess, the internal protrusion having a second shape different than the first shape that is configured to receive a second type of candle shape in the second recess, the internal surface is integrally formed with the peripheral surface and extends inwardly from peripheral surface.

An example candle delivery apparatus disclosed herein includes a peripheral surface comprising a top side and a bottom side, wherein the top side of the peripheral surface includes a plurality of peripheral protrusions, each of the plurality of peripheral protrusions having a first shape configured to receive a first type of candle and each of the plurality of peripheral protrusions including a first recess and one or more ribs; and at least one internal surface including an internal protrusion, the internal protrusion including a second recess, the internal protrusion having a second shape different than the first shape that is configured to receive a second type of candle shape in the second recess, the internal surface is integrally formed with the peripheral surface and extends inwardly from peripheral surface.

While various novel features of the invention have been shown, described, and pointed out as applied to particular embodiments thereof, it should be understood that various omissions and substitutions and changes in the form and details of the systems and methods described, may be made by those skilled in the art without departing from the spirit of the invention. Amongst other things, the steps in the methods may be carried out in different orders in many cases where such may be appropriate. Those skilled in the art will recognize, based on the above disclosure and an understanding therefrom of the teachings of the invention and the general functionality provided by and incorporated therein, may vary in different embodiments of the invention. Accordingly, the description of system components are for illustrative purposes to facilitate a full and complete understanding and appreciation of the various aspects and functionality of particular embodiments of the invention as realized in system and method embodiments thereof. Those skilled in the art will appreciate that the invention can be practiced in other than the described embodiments, which are presented for purposes of illustration and not limitation. Variations, modifications, and other implementations of what is described herein may occur to those of ordinary skill in the art without departing from the spirit and scope of the present invention.

What is claimed is:

1. A food protection apparatus, the apparatus comprising:

a base portion;

a removable covering coupled to the base portion, the removable covering including a top surface and one or more side walls, the top surface integrally connected to the one or more side walls; and a candle delivery apparatus configured to be coupled to the top surface of the removable covering, the candle delivery apparatus including:

a peripheral surface comprising a top side and a bottom side, wherein the top side of the peripheral surface includes a plurality of peripheral protrusions, each of the plurality of peripheral protrusions having a first shape configured to receive a first type of candle and each of the plurality of peripheral protrusions including a first recess and one or more ribs; and at least one internal surface including an internal protrusion, the internal protrusion including a second recess, the internal protrusion having a second shape different than the first shape that is configured to receive a second type of candle shape in the second recess, the internal protrusion includes an aperture on a bottom surface of the internal protrusion, the internal surface is integrally formed with the peripheral surface and extends inwardly from peripheral surface.

2. The apparatus of claim 1, wherein the first recess includes an internal surface, the one or more ribs extending outward from the internal surface.

3. The apparatus of claim 1, wherein the one or more ribs have a first size at a first end adjacent to the top side of the peripheral surface and a second size at a second end opposite the first end, the second size different than the first size.

4. The apparatus of claim 3, wherein the one or more ribs form a blade-type shape.

5. The apparatus of claim 1, wherein:

the removable covering is coupled to the base portion by a portion of the side walls;

the removable covering and the base portion define a cavity.

6. The apparatus of claim 5, wherein the candle delivery apparatus is positioned on the top surface of the removable covering to position the one or more candles external to the cavity.

7. The apparatus of claim 5, wherein the removable covering and the base portion include micro-perforations to permit fluid into the cavity to mitigate spoilage of food products to be positioned in the cavity.

8. The apparatus of claim 1, wherein at least one of the removable covering, the base portion, or the candle delivery apparatus are fabricated from one or more of the following materials: polymers, vinyl, plastics, glass materials, wood materials, silicone, foam materials, and/or metals.

9. The apparatus of claim 1, wherein the one or more side walls are to be collapsible to reduce a size of the removable covering.

10. The apparatus of claim 1, wherein at least one of the removable covering, the base portion, or the candle delivery apparatus are treated with one or more decontaminating substances.

11. The apparatus of claim 1, wherein the internal protrusion includes a circumferential protrusion on an external surface of the internal protrusion, the second shape of the internal protrusion being rectangular and the circumferential protrusion having a third shape that is circular.

12. A candle delivery apparatus, the apparatus comprising:

a peripheral surface comprising a top side and a bottom side, wherein the top side of the peripheral surface includes a plurality of peripheral protrusions, each of the plurality of peripheral protrusions having a first shape configured to receive a first type of candle and each of the plurality of peripheral protrusions including a first recess and one or more ribs, the first recess includes a first diameter, further including a third recess on a bottom surface of the first recess, the third recess having a second diameter, the second diameter different than the first diameter; and at least one internal surface including an internal protrusion, the internal protrusion including a second recess, the internal protrusion having a second shape different than the first shape that is configured to receive a second type of candle shape in the second recess, the internal surface is integrally formed with the peripheral surface and extends inwardly from peripheral surface.

13. The apparatus of claim 12, wherein the first recess and the second recess include at least four ribs on an internal surface.

14. The apparatus of claim 12, wherein the one or more ribs have a first size at a first end adjacent to the top side of the peripheral surface and a second size at a second end opposite the first end, the second size different than the first size.

15. The apparatus of claim 14, wherein the one or more ribs form a blade-type shape.

16. The apparatus of claim 12, wherein the internal protrusion includes a circumferential protrusion formed on an external surface of the internal protrusion.

17. The apparatus of claim 12, wherein the peripheral surface is a top surface, further including a bottom surface, wherein the peripheral protrusion is formed on the top surface, the bottom surface including a connection mechanism for coupling the candle delivery apparatus to a surface.

18. The apparatus of claim 1, wherein the plurality of peripheral protrusions are separated by a plurality of apertures.

19. A food protection apparatus, the apparatus comprising:

a base portion;

a removable covering coupled to the base portion, the removable covering including a top surface and one or more side walls, the top surface integrally connected to the one or more side walls, the removable covering is coupled to the base portion by a portion of the side walls, the removable covering and the base portion define a cavity, the removable covering and the base portion include micro-perforations to permit fluid into the cavity to mitigate spoilage of food products to be positioned in the cavity; and a candle delivery apparatus configured to be coupled to the top surface of the removable covering, the candle delivery apparatus including:

a peripheral surface comprising a top side and a bottom side, wherein the top side of the peripheral surface includes a plurality of peripheral protrusions, each of the plurality of peripheral protrusions having a first shape configured to receive a first type of candle and each of the plurality of peripheral protrusions including a first recess and one or more ribs; and at least one internal surface including an internal protrusion, the internal protrusion including a second recess, the internal protrusion having a second shape different than the first shape that is configured to receive a second type of candle shape in the second recess, the internal surface is integrally formed with the peripheral surface and extends inwardly from peripheral surface.

20. A food protection apparatus, the apparatus comprising:

a base portion;

a removable covering coupled to the base portion, the removable covering including a top surface and one or more side walls, the top surface integrally connected to the one or more side walls; and a candle delivery apparatus configured to be coupled to the top surface of the removable covering, the candle delivery apparatus including:

a peripheral surface comprising a top side and a bottom side, wherein the top side of the peripheral surface includes a plurality of peripheral protrusions, each of the plurality of peripheral protrusions having a first shape configured to receive a first type of candle and each of the plurality of peripheral protrusions including a first recess and one or more ribs; and at least one internal surface including an internal protrusion, the internal protrusion including a second recess, the internal protrusion having a second shape different than the first shape that is configured to receive a second type of candle shape in the second recess, the internal protrusion includes a circumferential protrusion on an external surface of the internal protrusion, the second shape of the internal protrusion being rectangular and the circumferential protrusion having a third shape that is circular, the internal surface is integrally formed with the peripheral surface and extends inwardly from peripheral surface.

21. A candle delivery apparatus, the apparatus comprising:

a peripheral surface comprising a top side and a bottom side, wherein the top side of the peripheral surface includes a plurality of peripheral protrusions, each of the plurality of peripheral protrusions having a first shape configured to receive a first type of candle and each of the plurality of peripheral protrusions including a first recess and one or more ribs; and at least one internal surface including an internal protrusion, the internal protrusion including a second recess, the internal protrusion having a second shape different than the first shape that is configured to receive a second type of candle shape in the second recess, the internal protrusion includes a circumferential protrusion formed on an external surface of the internal protrusion, the internal surface is integrally formed with the peripheral surface and extends inwardly from peripheral surface.

22. A candle delivery apparatus, the apparatus comprising:

a peripheral surface comprising a top side and a bottom side, wherein the top side of the peripheral surface includes a plurality of peripheral protrusions that are separated by a plurality of apertures, each of the plurality of peripheral protrusions having a first shape configured to receive a first type of candle and each of the plurality of peripheral protrusions including a first recess and one or more ribs; and at least one internal surface including an internal protrusion, the internal protrusion including a second recess, the internal protrusion having a second shape different than the first shape that is configured to receive a second type of candle shape in the second recess, the internal surface is integrally formed with the peripheral surface and extends inwardly from peripheral surface.

* * * * *